US008749165B2

(12) United States Patent
Chen et al.

(10) Patent No.: US 8,749,165 B2
(45) Date of Patent: Jun. 10, 2014

(54) LIGHT SOURCE DRIVING DEVICE INCLUDING A SWITCHING CURRENT ADJUSTMENT CIRCUIT

(75) Inventors: Yung-Chuan Chen, Tainan (TW); Ching-Ran Lee, Kinmen County (TW); Hung-Chun Li, Taoyuan County (TW); Yao-Te Huang, Changhua County (TW)

(73) Assignee: Industrial Technology Research Institute, Hsinchu (TW)

( * ) Notice: Subject to any disclaimer, the term of this patent is extended or adjusted under 35 U.S.C. 154(b) by 334 days.

(21) Appl. No.: 13/244,635

(22) Filed: Sep. 25, 2011

(65) Prior Publication Data

US 2012/0299507 A1 Nov. 29, 2012

(30) Foreign Application Priority Data

May 27, 2011 (TW) ..... 100118697 A

(51) Int. Cl.
*G05F 1/00* (2006.01)

(52) U.S. Cl.
USPC ..... 315/291; 315/307; 315/185 S; 315/224; 315/247

(58) Field of Classification Search
USPC ..... 315/247, 224, 225, 246, 185 S, 291, 315/307–326
See application file for complete search history.

(56) References Cited

U.S. PATENT DOCUMENTS

| | | | | |
|---|---|---|---|---|
| 6,304,007 | B1 | 10/2001 | Yu | |
| 6,549,792 | B1 | 4/2003 | Cannon et al. | |
| 7,061,212 | B2 | 6/2006 | Phadke | |
| 7,178,971 | B2 | 2/2007 | Pong et al. | |
| 7,388,761 | B1 | 6/2008 | Wang et al. | |
| 7,626,342 | B2 | 12/2009 | Sun et al. | |
| 7,750,616 | B2 | 7/2010 | Liu | |
| 7,800,565 | B2 | 9/2010 | Nathan et al. | |
| 2007/0236968 | A1 | 10/2007 | Wu et al. | |
| 2009/0206804 | A1 | 8/2009 | Xu et al. | |
| 2010/0014326 | A1 | 1/2010 | Gu et al. | |
| 2011/0109241 | A1 * | 5/2011 | Kitamura | 315/291 |
| 2012/0074866 | A1 * | 3/2012 | Zhang et al. | 315/291 |
| 2013/0134893 | A1 * | 5/2013 | Zimmermann et al. | 315/224 |

FOREIGN PATENT DOCUMENTS

| | | |
|---|---|---|
| TW | 564390 | 12/2003 |
| TW | 493154 | 7/2009 |
| TW | I316319 | 10/2009 |
| TW | M372997 | 1/2010 |

(Continued)

OTHER PUBLICATIONS

Beibei Wang et al.,"A Method of Reducing the Peak-to-Average Ratio of LED Current for Electrolytic Capacitor-Less AC-DC Drivers", IEEE Transactions on Power Electronics, vol. 25, No. 3, Mar. 2010, pp. 592-601.

(Continued)

*Primary Examiner* — Tuyet Thi Vo
(74) *Attorney, Agent, or Firm* — Jianq Chyun IP Office

(57) ABSTRACT

A light source driving device configured to drive a light-emitting unit is provided. The light source driving device includes a direct voltage source, a first capacitance unit, and a switching current adjustment circuit. The direct voltage source is coupled with the light-emitting unit and supplies a direct voltage. The first capacitance unit and the light-emitting unit are connected in parallel. The switching current adjustment circuit and the light-emitting unit are connected in series. The switching current adjustment circuit is configured to bear a part of a voltage stress of the direct voltage source and is configured to switch the direct voltage.

22 Claims, 13 Drawing Sheets

(56) References Cited

FOREIGN PATENT DOCUMENTS

| | | |
|---|---|---|
| TW | 201006105 | 2/2010 |
| TW | 201006106 | 2/2010 |
| TW | 201040688 | 11/2010 |
| TW | 201044756 | 12/2010 |

OTHER PUBLICATIONS

Linlin Gu et al., "Means of eliminating electrolytic capacitor in ac-dc power supplies for LED lightings", IEEE Transactions on Power Electronics, vol. 24, No. 5, May 2009, pp. 1399-1408.

S.Y.R. Hui et al., "A novel passive off-line light-emitting diode (LED) driver with long lifetime", Applied Power Electronics Conference and Exposition (APEC), 2010 Twenty-Fifth Annual IEEE, Issue Date: Feb. 21-25, 2010, pp. 594-600.

Julu Sun et al., "High Efficiency Quasi-Parallel Voltage Regulators", Applied Power Electronics Conference and Exposition, 2008. APEC 2008. Twenty-Third Annual IEEE, Issue Date: Feb. 24-28, 2008, pp. 811-817.

Ming Xu et al., "Σsigma DCDC conversion for computing and telecom applications", Power Electronics Specialists Conference, 2008. PESC 2008. IEEE, Issue Date: Jun. 15-19, 2008, pp. 1190-1195.

Wensong Yu et al., "High efficiency DC-DC converter with twin-bus for dimmable LED lighting", Energy Conversion Congress and Exposition (ECCE), 2010 IEEE, Issue Date: Sep. 12-16, 2010, pp. 457-462.

Wai-Keung Lun et al., "Bilevel Current Driving Technique for LEDs", IEEE Transactions on Power Electronics, vol. 24, No. 12, Dec. 2009, pp. 2920-2932.

* cited by examiner

LIGHT SOURCE DRIVING DEVICE INCLUDING A SWITCHING CURRENT ADJUSTMENT CIRCUIT

CROSS-REFERENCE TO RELATED APPLICATION

This application claims the priority benefit of Taiwan application serial no. 100118697, filed on May 27, 2011. The entirety of the above-mentioned patent application is hereby incorporated by reference herein and made a part of this specification.

BACKGROUND

1. Technical Field

The disclosure is related to a driving device, and in particular to a light source driving device.

2. Related Art

Solid state light sources, such as light-emitting diodes (LED) and organic LEDs (OLED) have advantages such as small volume, long life spans, high reliability, no radiation or toxic substances such as mercury. Solid state light sources have thus become the focus of development in the most popular new greentech optoelectronic industry and are deemed to have the greatest potential to replace conventional fluorescent light tubes or incandescent light bulbs and become applied in the lighting market. Therefore, for a solid state light source driver, the ability to provide stable power for the solid state light source has become a basic requirement. Currently, for manufacturers related to solid state light sources, the increase in life spans of solid state light source drivers, reduction of costs, and reduction in sizes of integrated circuits have become hallmarks in their competition in aspects of technology and costs.

An LED has characteristics similar to those of a diode. A brightness thereof is proportional to a supplied current. However, a thermal characteristic of an LED is similar to that of a negative resistor. The higher the temperature, the lower the resistance. Therefore, when a constant voltage is supplied to the LED, an increase in temperature often leads to a drastic increase in an LED current, thereby damaging the LED chip. Therefore, in conventional driver designs, a constant current is generally used, so as to prevent overheating of the LED which would lead to short circuiting or breakage of the device.

However, in a conventional driver, an active switching device often bears all of a voltage stress of a power source. This not only increases power consumption but also reduces the life span. Furthermore, after an electrolytic capacitor used by a conventional driver is used for a prolonged period, an electrolyte therein easily dries out, thereby leading to rapid deterioration and damage of the electrolytic capacitor. This is the main reason why life spans of conventional LEE) drivers cannot be effectively increased.

SUMMARY

An embodiment of the disclosure provides a light source driving device which is configured to drive a light-emitting unit. The light source driving device includes a direct voltage source, a first capacitance unit, and a switching current adjustment circuit. The direct voltage source is coupled with the light-emitting unit, so as to provide a direct voltage. The first capacitance unit and the light, emitting unit are connected in parallel, and the switching current adjustment unit and the light-emitting unit are connect in series, wherein the switching current adjustment circuit is configured to bear a part of a voltage stress of the direct voltage source and is configured to switch the direct voltage.

Several exemplary embodiments accompanied with figures are described in detail below to further describe the disclosure in details.

BRIEF DESCRIPTION OF THE DRAWINGS

The accompanying drawings are included to provide a further understanding of the disclosure, and are incorporated in and constitute a part of this specification. The drawings illustrate embodiments of the disclosure and, together with the description, serve to explain the principles of the disclosure.

DETAILED DESCRIPTION OF DISCLOSED EMBODIMENTS

Figure 1:
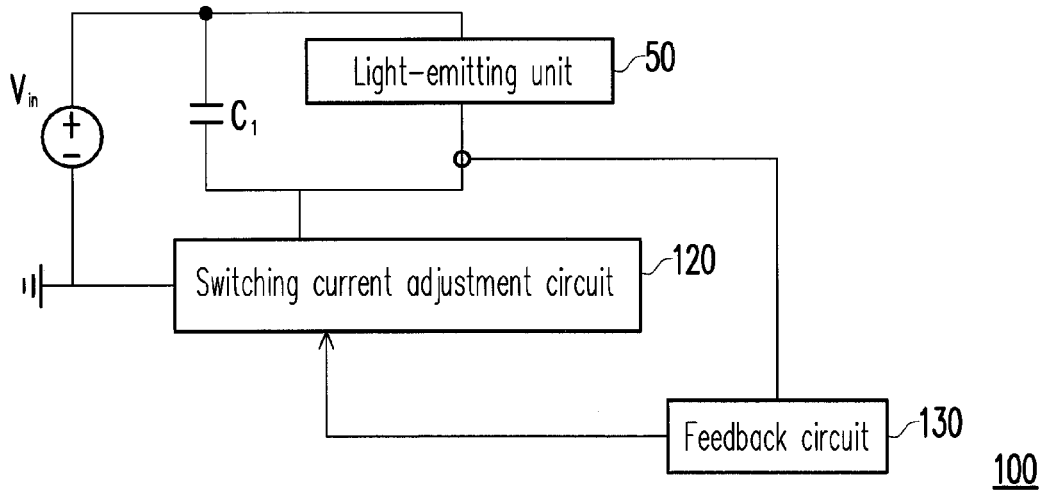
FIG. 1 is a schematic circuit diagram of a light source driving device according to an exemplary embodiment of the disclosure.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

FIG. 1 is a schematic circuit diagram of a light source driving device according to an exemplary embodiment of the disclosure. Please refer to FIG. 1. A light source driving device 100 according to the present embodiment is configured to drive a light-emitting unit 50. The light source driving device 100 includes a direct voltage source $V_{in}$, a first capacitance unit $C_1$, and a switching current adjustment circuit 120. The direct voltage source $V_{in}$ is coupled with the light-emitting unit 50, so as to provide a direct voltage. The first capacitance unit $C_1$ and the light-emitting unit 50 are connected in parallel. The switching current adjustment unit 120 and the light-emitting unit 50 are connected in series, wherein the switching current adjustment circuit 120 is configured to bear a part of a voltage stress of the direct voltage source $V_{in}$ and is configured to switch the direct voltage. An average current which flows through the light-emitting unit 50 is controlled within a suitable range, so as to prevent short or open circuiting of the device caused by overheating of the light-emitting unit. According to the present embodiment, the light-emitting unit 50 includes at least one solid state light source. According to the present embodiment, the light-emitting unit 50 includes a plurality of solid state light sources connected in series. The solid state light source is, for example, an LED or OLED. According to the present embodiment, the solid state light source is an LED.

According to the present embodiment, since the switching current adjustment circuit bears a part of the voltage stress of the direct voltage $V_{in}$, switching loss is reduced, and a high conversion efficiency is achieved. In addition, since the voltage stress born by the switching current adjustment circuit 120 is low, a capacitance value of the first capacitance unit $C_1$ is able to be reduced by increasing a switching frequency of the switching current adjustment circuit 120. Therefore, the first capacitance unit $C_1$ is able to utilize a non-electrolytic capacitor, so as to increase the life span of the first capacitance unit $C_1$, thereby increasing the life span of the light source driving device 100. According to the present embodiment, the first capacitance unit $C_1$ may include at least one plastic thin film capacitor. However, according to another embodiment, a ceramic capacitor, a laminated ceramic capacitor, or another non-electrolytic capacitor may be used to replace the plastic thin film capacitor. According to the present embodiment, the light-emitting unit 50 bears most of the direct voltage, and a magnitude of the voltage born by the light-emitting unit 50 is determined by a magnitude of a forward voltage of the solid state light source. In addition, the switching current adjustment circuit 120 bears a smaller part of the direct voltage.

According to the present embodiment, the light-emitting unit 50 is coupled between a positive end of the direct voltage source and the switching current adjustment circuit. Also, according to the present embodiment, the light source driving device 100 further includes a feedback circuit 130 which is configured to detect a current which passes through the light-emitting unit 50. A duty cycle of a driving signal of the switching current adjustment circuit 120 is adjusted according to the current which passes through the light-emitting unit 50, so as to adjust the average current which passes through the light-emitting unit 50. Therefore, the average current which passes through the light-emitting unit 50 is controlled within a suitable range, so as to prevent short or open circuiting of the device caused by overheating of the light-emitting unit 50.

The switching current adjustment circuit 120 may be implemented in a plurality of different manners, some of which are described in embodiments in the following. Moreover, the following also describes in detail a structure of the feedback circuit 130 and a way by which the feedback circuit 130 controls the switching current adjustment circuit 120.

Figure 2:
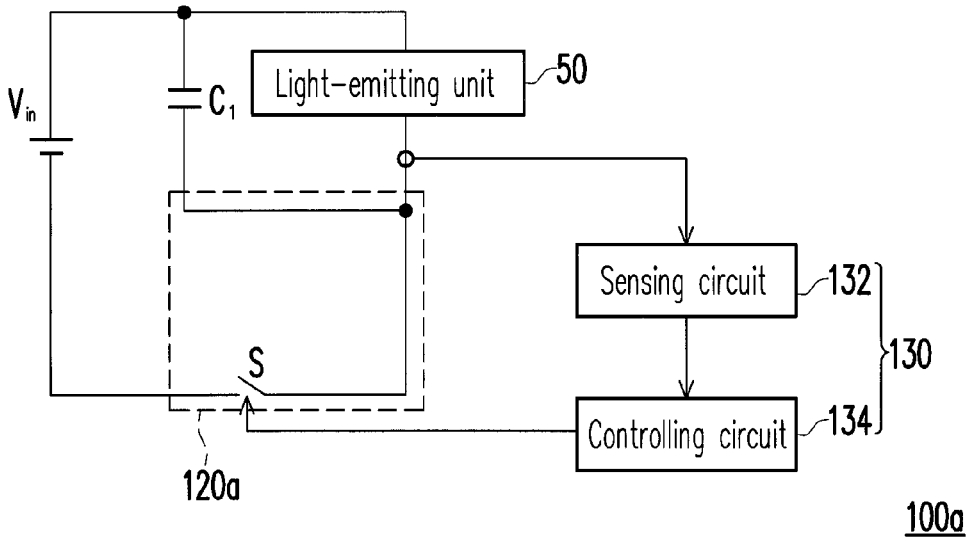
FIG. 2 is a schematic circuit diagram of a light source driving device according to another exemplary embodiment of the disclosure.

FIG. 2 is a schematic circuit diagram of a light source driving device according to another exemplary embodiment of the disclosure. Please refer to FIG. 2. A light source driving device 100*a* according to this embodiment is an implementation of the light source driving device 100 in FIG. 1. In the light source driving device 100*a*, a switching current adjustment circuit 120*a* includes a power switch S which is connected with the light-emitting device 50 in series. The power switch S is, for example, a transistor. According to the present embodiment, the power switch S is, for example, a field effect transistor (FET). However, according to another embodiment, the power switch S may also be a bipolar junction transistor (BJT). When the power switch S is turned on, a cross voltage of the first capacitance unit $C_1$ is approximately the direct voltage provided by the direct voltage source $V_{in}$. When the power switch S is turned off, the first capacitance unit $C_1$ discharges to provide a current to the light-emitting unit 50. Also, according to the present embodiment, the feedback circuit 130 is configured to detect the current which passes through the light-emitting unit 50. The duty cycle of the driving signal of the switching current adjustment circuit is adjusted according to the current which passes through the light-emitting unit 50, so as to adjust the average current which passes through the light-emitting unit 50.

Specifically, according to the present embodiment, the feedback circuit 130 includes a sensing circuit 132 and a controlling circuit 134. The sensing circuit 132 is configured to detect the current which passes through the light-emitting unit 50 (such as a forward current of the LED) to generate a feedback signal. The controlling circuit 134 is configured to determine the duty cycle of the driving signal of the power switch S according to the feedback signal. According to the present embodiment, when the controlling circuit 134 determines that the current which passes through the light-emitting unit is too strong, the duty cycle of the driving signal of the power switch S is reduced, so as to reduce the average current which passes through the light-emitting unit 50. On the other hand, when the controlling circuit determines that the current which passes through the light-emitting unit 50 is too weak, the duty cycle of the driving signal of the power switch S is increased, so as to increase the average current which passes through the light-emitting unit 50. According to the present embodiment, the controlling circuit 134 includes an analog controlling integrated circuit or a digital microprocessor. For the light source driving device 100*a* according to the present embodiment, since no voluminous magnetic devices (such as inductors) are required, the light source driving device 100*a* and the light-emitting unit 50 are able to be packaged on a same substrate (such as a circuit board) or fabricated as a drive integrated circuit (drive IC), so as to decrease the size of the device and greatly increase applicability.

Figure 3A:
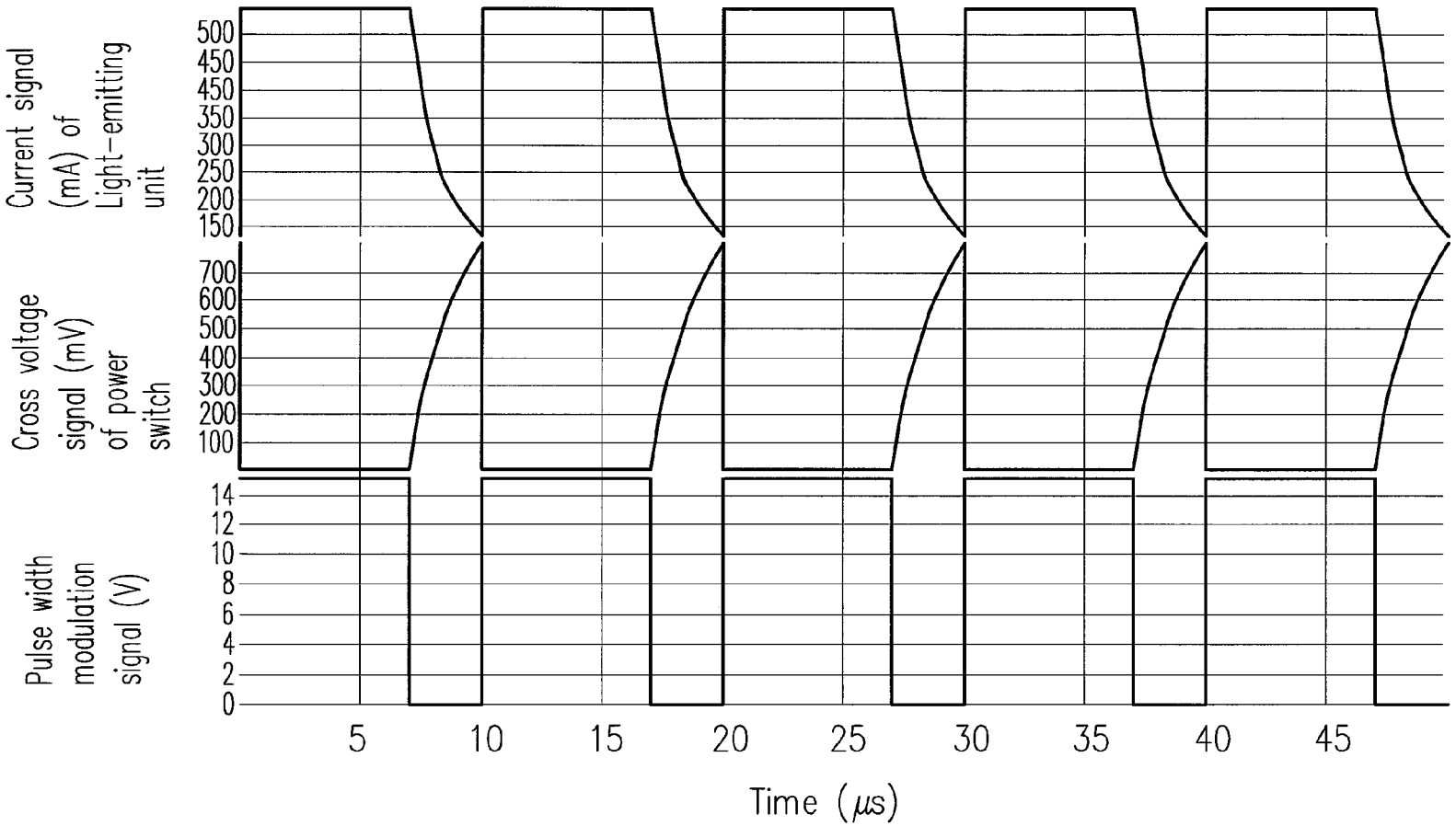
FIGS. 3A and 3B are simulated waveform diagrams of the light source driving device in FIG. 2.
Figure 3B:
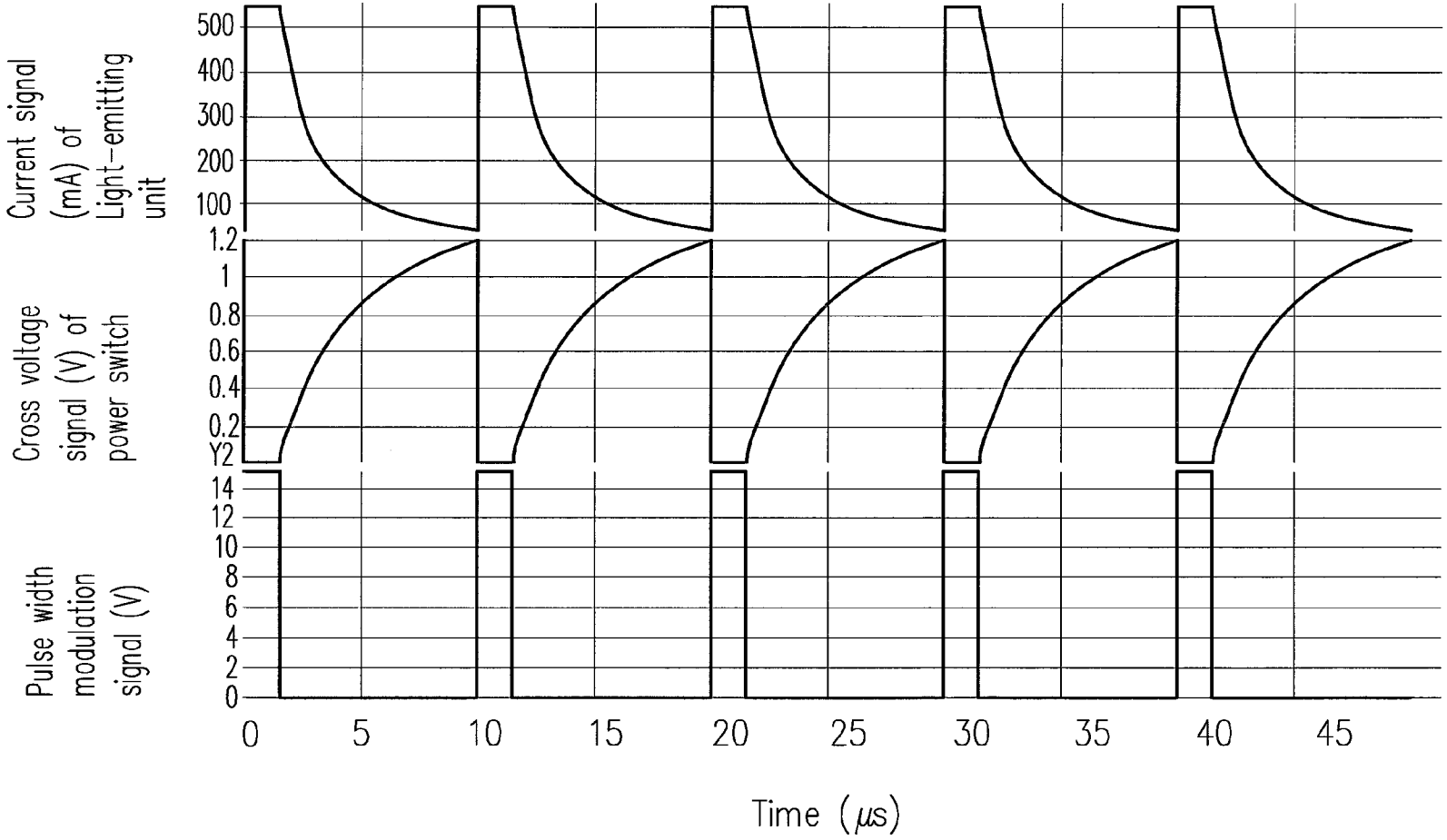

FIGS. 3A and 3B are simulated waveform diagrams of the light source driving device in FIG. 2. Please refer to FIGS. 2, 3A, and 3B. In the figures, a pulse width modulation (PWM) signal is the driving signal which the controlling circuit 134 uses to drive the power switch S. In FIG. 3A, the duty cycle of the PWM signal is, for example, 70%. In FIG. 3B, the duty cycle of the PWM signal is, for example, 15%. Moreover, the simulated waveforms in FIGS. 3A and 3B are simulated with the following parameters. The direct voltage is 12 V, the first capacitance unit $C_1$ is a 1 μF capacitor, the power switch S is an ideal voltage driving switch, the light-emitting unit 50 is four LEDs connected in series, and a switching frequency of the power switch S is 100 kHz. The disclosure, however, is not limited to this configuration. Moreover, in FIGS. 3A and 3B, a cross voltage signal of the power switch is a cross voltage waveform between two ends of the power switch S, and the current signal of the light-emitting unit is a current waveform passing through the light-emitting unit 50. In FIG. 3A, the average current which passes through the light-emitting unit is 461.7 mA. On the other hand, in FIG. 3B, the average current which passes through the light-emitting unit 50 is 202.3 mA. Therefore, as verified by FIGS. 3A and 3B, by changing the duty cycle of the driving signal of the power switch S, the average current which passes through the light-emitting unit 50 is adjusted and maintained at greater than 0. The greater the duty cycle, the strong the average current; the smaller the duty cycle, the weaker the average current.

Figure 4:
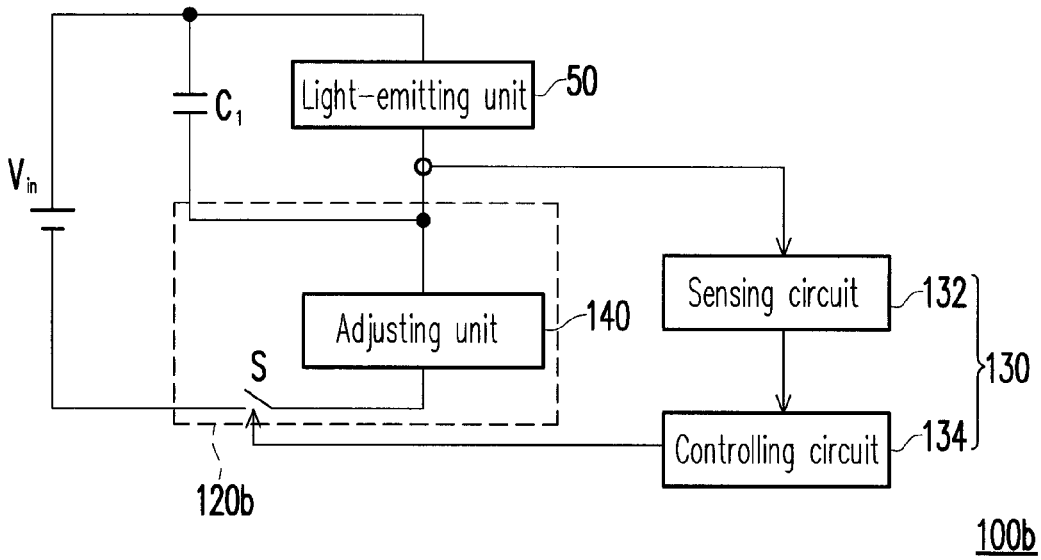
FIG. 4 is a schematic circuit diagram of a light source driving device according to another exemplary embodiment of the disclosure.

FIG. 4 is a schematic circuit diagram of a light source driving device according to another exemplary embodiment of the disclosure. Please refer to FIG. 4. A light source driving device 100*b* according to this embodiment is similar to the light source driving device 100*a* in FIG. 2. Differences in between are described in the following. In the light source driving device 100*b* according to the present embodiment, a switching current adjustment circuit 120*b* further includes an adjusting unit 140 which is connected with the power switch S in series and includes at least one of the above solid state light source, diode, and resistor. A voltage drop generated by the adjusting unit 140 assists the power switch to adjust the average current which passes through the light-emitting unit 50. When the adjusting unit 140 includes at least one solid state light source, a number of the solid state light source in the adjusting unit 140 may be equal to or different from a number of the solid state light source in the light-emitting unit 50.

Figure 5A:
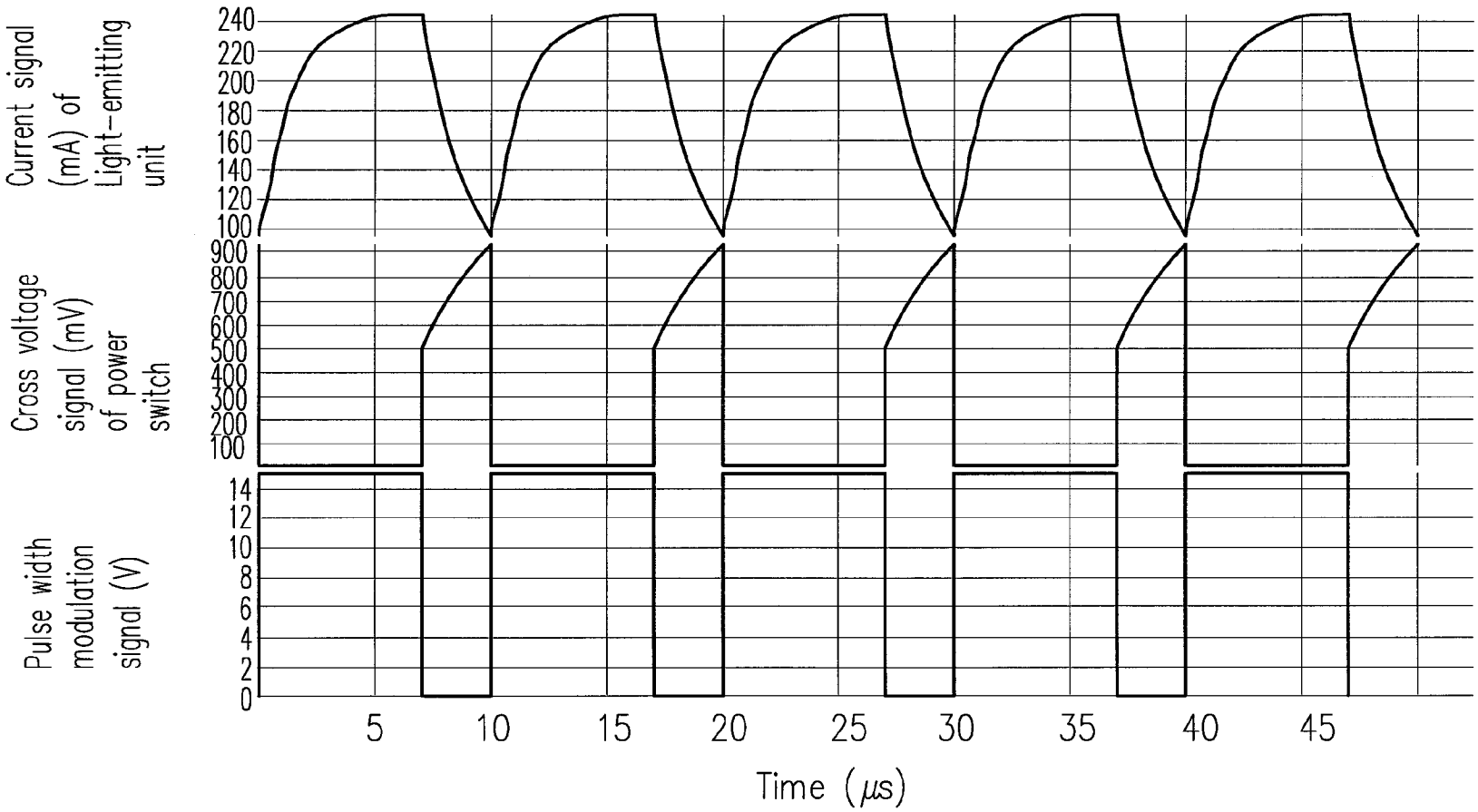
FIGS. 5A and 5B are simulated waveform diagrams of the light source driving device in FIG. 4.
Figure 5B:
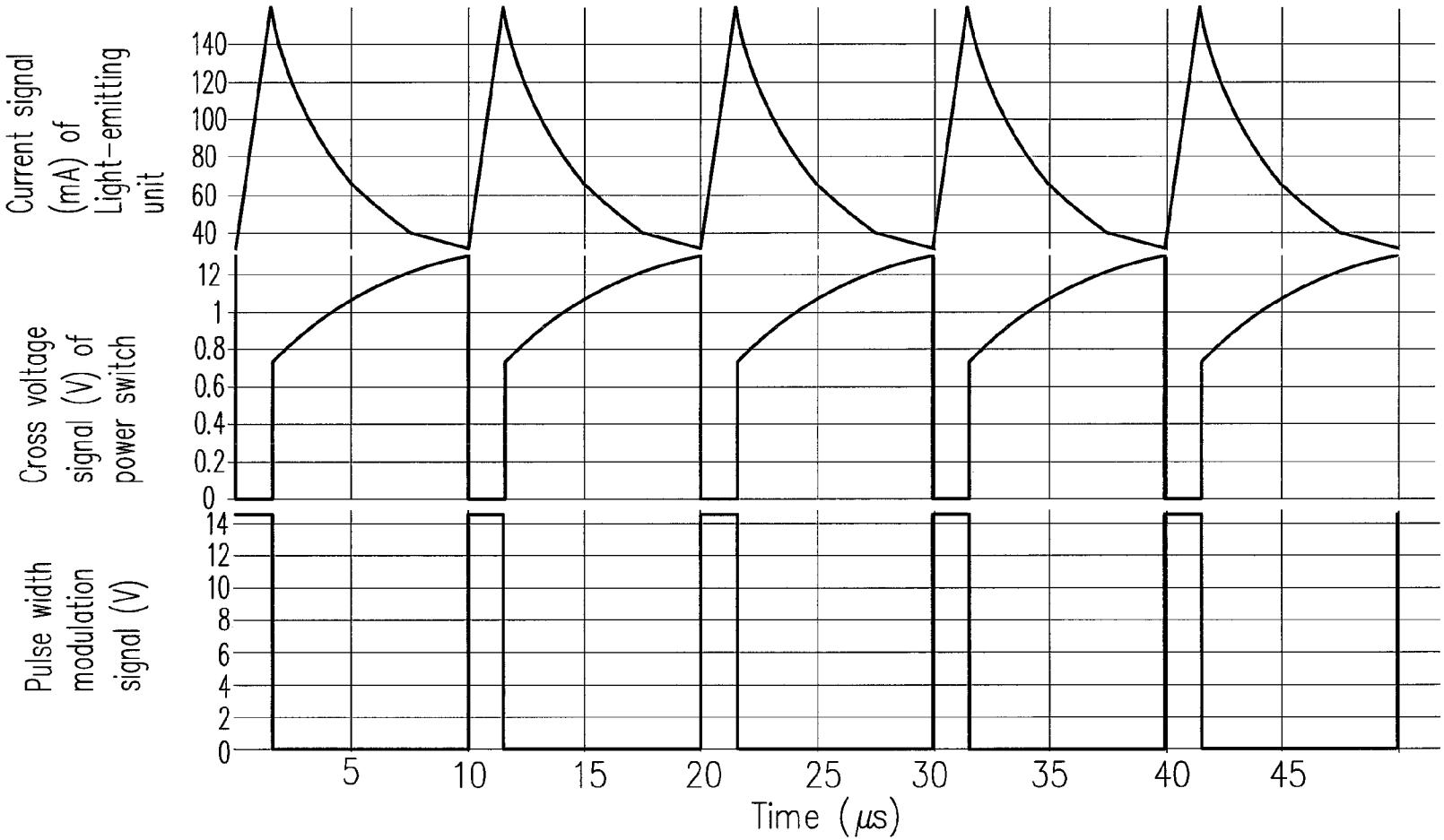

FIGS. 5A and 5B are simulated waveform diagrams of the light source driving device in FIG. 4. Please refer to FIGS. 4, 5A, and 5B. The physical significance of the horizontal and vertical axes in FIGS. 5A and 5B is referred to in the description of the above FIGS. 3A and 3B and is hence not repeated described. In FIG. 5A, the duty cycle of the PWM signal is, for example, 70%. In FIG. 5B, the duty cycle of the PWM signal is, for example, 15%. Moreover, the simulated waveforms in FIGS. 5A and 5B are simulated with the following parameters. The direct voltage is 12 V, the first capacitance unit $C_1$ is a 1 μF capacitor, the power switch S is an ideal voltage driving switch, the light-emitting unit 50 is four LEDs connected in series, the adjusting unit 140 is a 2Ω resistor, and a switching frequency of the power switch S is 100 kHz. The disclosure, however, is not limited to this configuration. In FIG. 5A, the average current which passes through the light-emitting unit is 197 mA. On the other hand, in FIG. 5B, the average current which passes through the light-emitting unit is 71.6 mA. Therefore, as verified by FIGS. 5A and 5B, the adjusting unit 140 is able to assist the power switch to adjust the average current which passes through the light-emitting unit 50.

Figure 6:
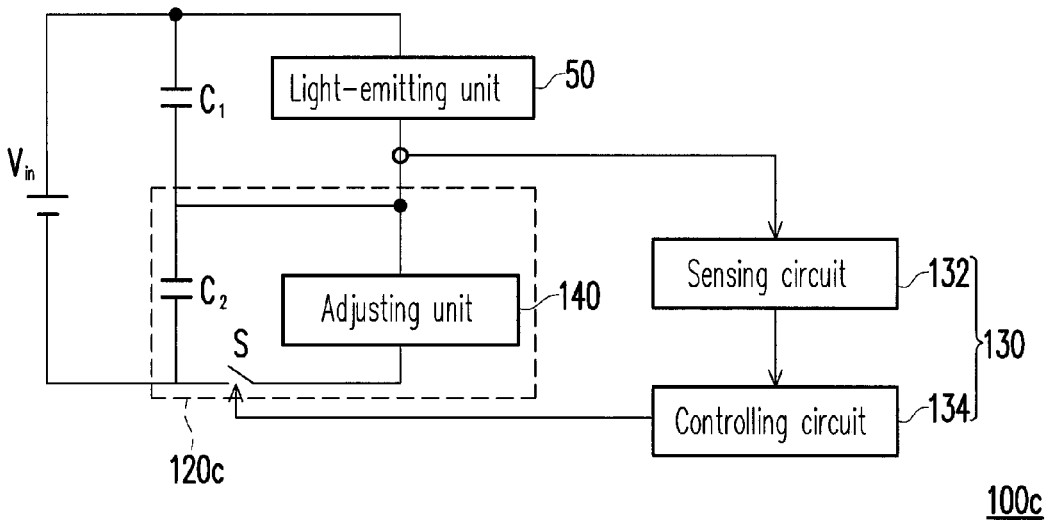
FIG. 6 is a schematic circuit diagram of a light source driving device according to another exemplary embodiment of the disclosure.

FIG. 6 is a schematic circuit diagram of a light source driving device according to another exemplary embodiment of the disclosure. Please refer to FIG. 6. A light source driving device 100*c* according to this embodiment is similar to the light source driving device 100*b* in FIG. 4. Differences in between are described in the following. In the light source driving device 100*c* according to the present embodiment, a switching current adjustment circuit 120*c* further includes a second capacitance unit $C_2$ which is connected with the entirety of the power switch S and the adjusting unit 140 in parallel. When the power switch S is turned on, the light-emitting unit 50 is crossed over by the first capacitance unit $C_1$, and the adjusting unit 140 is crossed over by the second capacitance unit $C_2$. When the adjusting unit 140 is a solid state light source or a plurality of solid state light sources connected in series, cross voltages on the first capacitance unit $C_1$ and on the second capacitance unit $C_2$ are respectively a conductive forward voltage of the light-emitting unit 50 and a conductive forward voltage of the adjusting unit 140. Moreover, when the power switch S is turned off, the current still passes through the light-emitting unit 50, and the current passing through the adjusting unit 140 is cut off since the circuit is open. At this moment, a withstand voltage of the power switch S is approximately the conductive forward voltage of the adjusting unit 140.

The second capacitance unit $C_2$ is configured to reduce ripples of the current which passes through the light-emitting unit 50. According to the present embodiment, the second capacitance unit $C_2$ is able to utilize a non-electrolytic capacitor, e.g. a plastic thin film capacitor, so as to increase the life span of the second capacitance unit $C_2$, thereby increasing the life span of the light source driving device 100*c*. However, according to another embodiment, a ceramic capacitor, a laminated ceramic capacitor, or another non-electrolytic capacitor may be used to replace the plastic thin film capacitor.

Figure 7A:
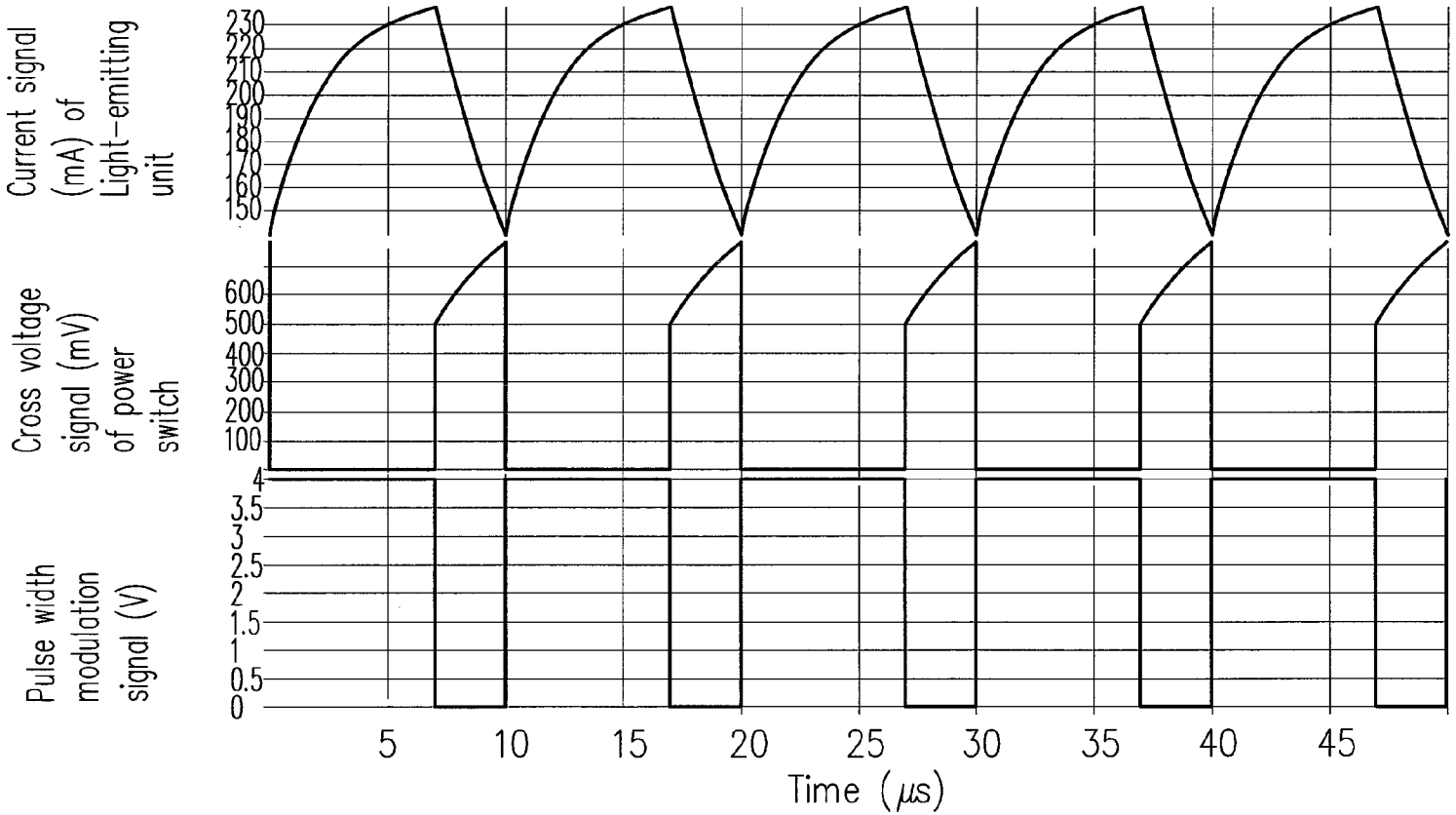
FIGS. 7A and 7B are simulated waveform diagrams of the light source driving device in FIG. 6.
Figure 7B:
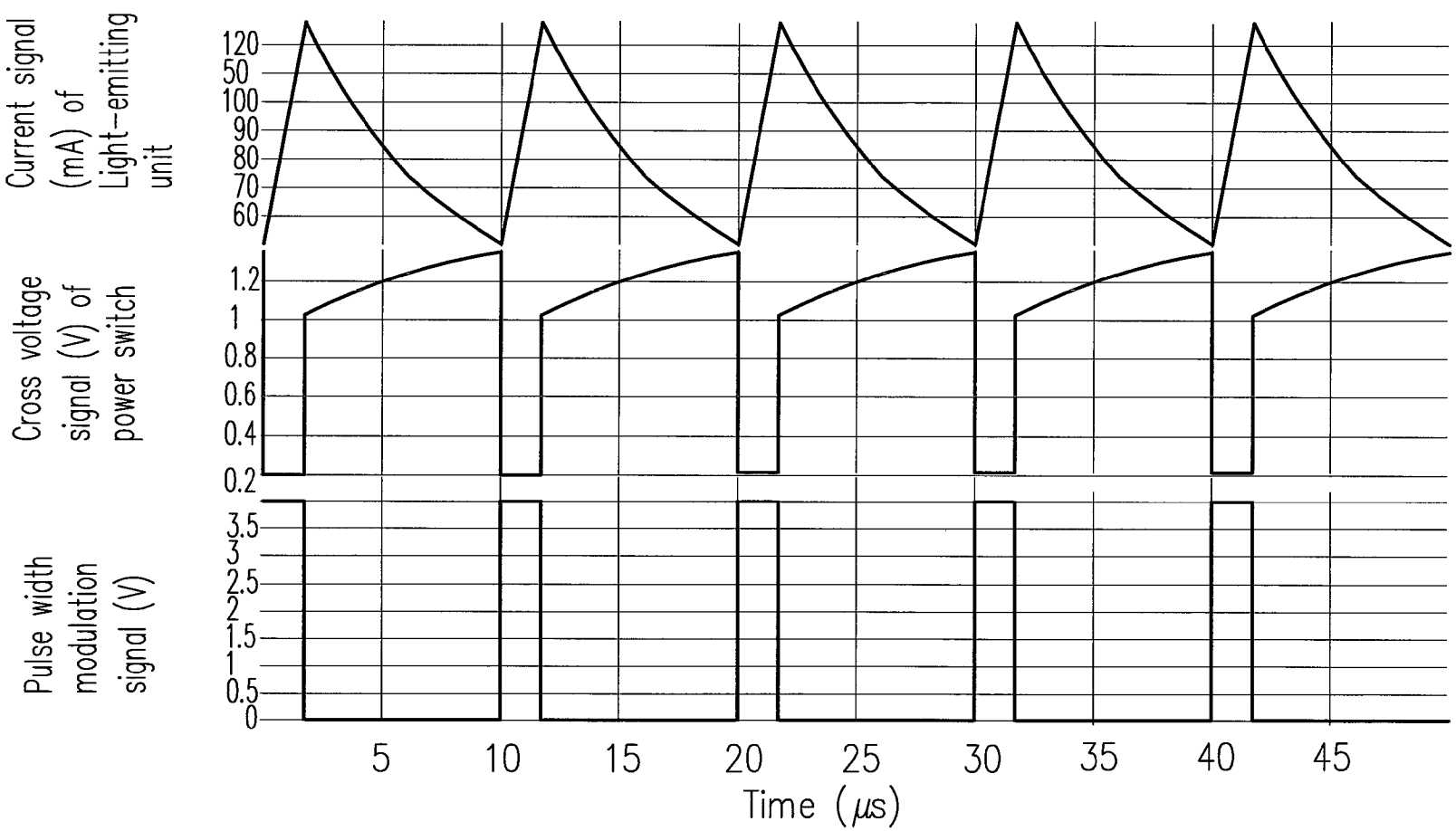

FIGS. 7A and 7B are simulated waveform diagrams of the light source driving device in FIG. 6. Please refer to FIGS. 6, 7A, and 7B. The physical significance of the horizontal and vertical axes in FIGS. 7A and 7B is referred to in the description of the above FIGS. 3A and 3B and is hence not repeated described. In FIG. 7A, the duty cycle of the PWM signal is, for example, 70%. In FIG. 7B, the duty cycle of the PWM signal is, for example, 15%. Moreover, the simulated waveforms in FIGS. 7A and 7B are simulated with the following parameters. The direct voltage is 12 V, the first capacitance unit $C_1$ is a 1 μF capacitor, the second capacitance unit $C_2$ is a 1 μF capacitor, the power switch S is an ideal voltage driving switch, the light-emitting unit 50 is four LEDs connected in series, the adjusting unit 140 is a 2Ω resistor, and a switching frequency of the power switch S is 100 kHz. The disclosure, however, is not limited to this configuration. In FIG. 7A, the average current which passes through the light-emitting unit is 202 mA, a maximum current is 237 mA, and a minimum current is 140 mA. Relative to FIG. 5A, in which a maximum current is 244 mA, and a minimum current is 95 mA, in FIG. 7A, ripples of the current which passes through the light-emitting unit 50 are significantly reduced. On the other hand, in FIG. 7B, the average current which passes through the light-emitting unit 50 is 82 mA, the maximum current is 127 mA, and the minimum current is 50 mA. Relative to FIG. 5B, in which a maximum current is 159.7 mA, and a minimum current is 31 mA, in FIG. 7B, ripples of the current which passes through the light-emitting unit 50 are significantly reduced. Therefore, as verified by FIGS. 7A and 7B, the second capacitance unit $C_2$ is indeed able to reduce ripples of the current which passes through the light-emitting unit 50.

Figure 8:
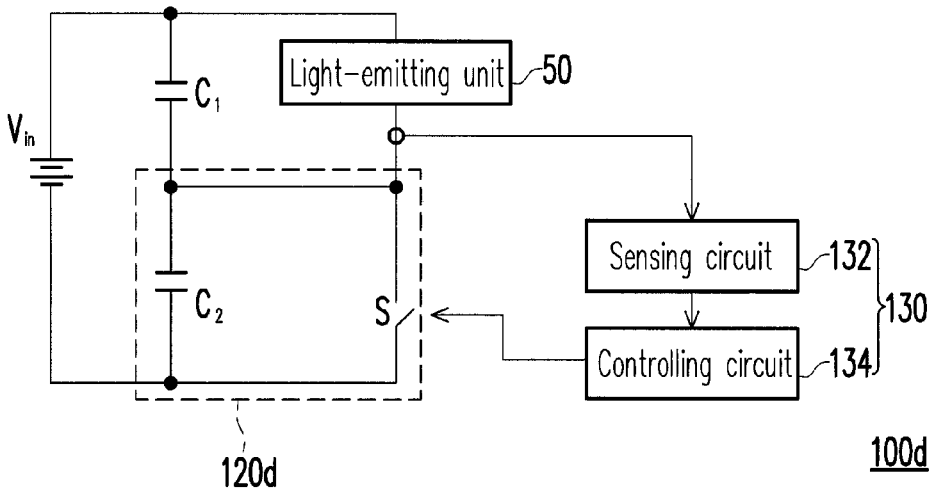
FIG. 8 is a schematic circuit diagram of a light source driving device according to another exemplary embodiment of the disclosure.

FIG. 8 is a schematic circuit diagram of a light source driving device according to another exemplary embodiment of the disclosure. Please refer to FIG. 8. A light source driving device 100*d* in this embodiment is similar to the light source driving device 100*c* in FIG. 6. Differences in between are described in the following. In the light source driving device 100*d* according to the present embodiment, a switching current adjustment circuit 120*d* does not include the adjusting unit 140, and the second capacitance unit $C_2$ and the power switch S are connected in parallel. When the power switch S is turned on, a direct voltage generated by the direct voltage source $V_{in}$ is directly supplied to the light-emitting unit 50. When the power switch S is turned off, the cross voltage on the first capacitance unit $C_1$ is supplied to the light-emitting unit 50. At this moment, the voltage of the first capacitance unit $C_1$ is approximately the conductive forward voltage of the light-emitting unit 50, and the voltage of the second capacitance unit $C_2$ is approximately the direct voltage minus the voltage of the first capacitance unit $C_1$.

The light source driving device 100*d* according to the present embodiment is also configured to adjust the current which passes through the light-emitting device 50.

Figure 9:
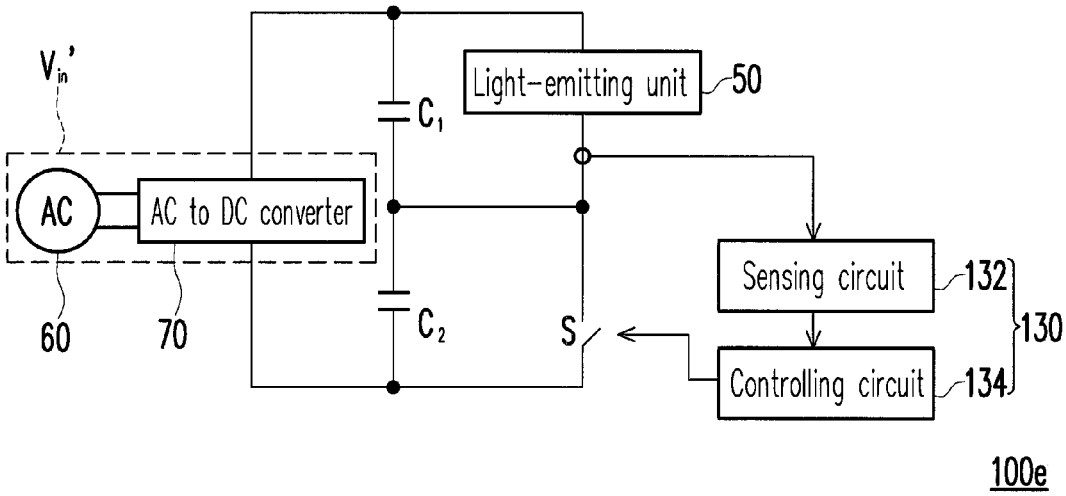
FIG. 9 is a schematic circuit diagram of a light source driving device according to another exemplary embodiment of the disclosure.

FIG. 9 is a schematic circuit diagram of a light source driving device according to another exemplary embodiment of the disclosure. Please refer to FIG. 9. A light source driving device 100*e* is similar to the light source driving device 100*d* in FIG. 8. A difference in between is that a direct voltage source $V_{in}'$ of the light source driving device 100*e* according to the present embodiment includes an alternating voltage source 60 and an AC to DC converter 70, wherein the AC to DC converter 70 converts the alternating voltage signal provided by the alternating voltage source 60 into a direct voltage signal. The AC to DC converter 70 may include a rectifying circuit (such as a bridge type rectifying circuit) and another suitable circuit in the AC to DC converter. The direct voltage source $V_{in}'$ according to the present embodiment may also be applied to another embodiment, so as to replace the direct voltage source $V_{in}$ according to the other embodiment. Moreover, according to an embodiment, the above direct voltage source $V_{in}$ may also be a pure direct voltage source, a pulse direct voltage source, or another type of suitable direct voltage source, wherein the pure direct voltage source is, for example, a battery.

Figure 10:
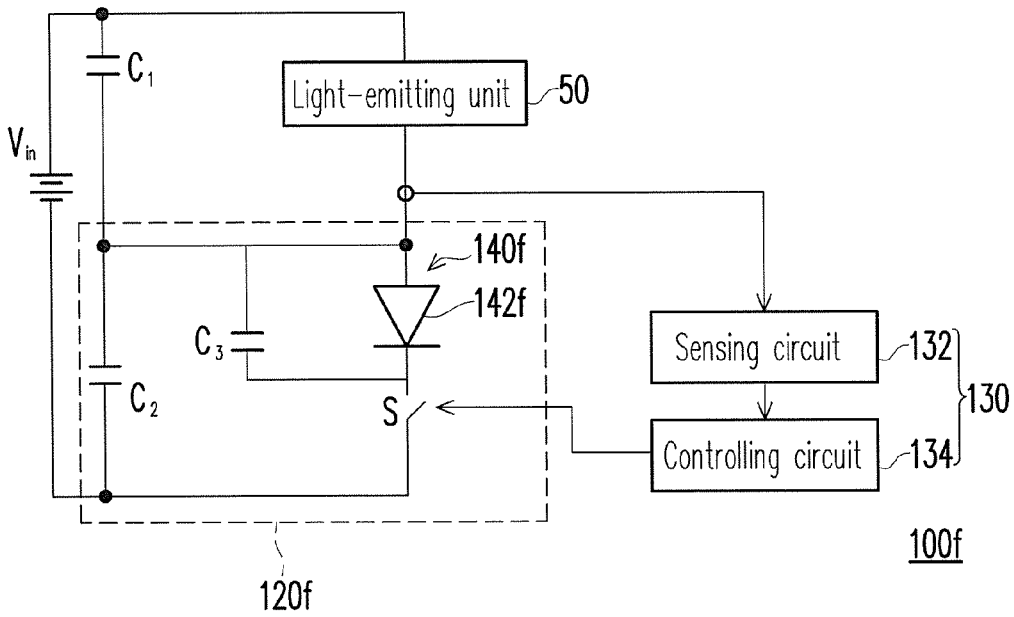
FIG. 10 is a schematic circuit diagram of a light source driving device according to another exemplary embodiment of the disclosure.

FIG. 10 is a schematic circuit diagram of a light source driving device according to another exemplary embodiment of the disclosure. Please refer to FIG. 10. A light source driving device 100*f* according to the present embodiment is similar to the light source driving device 100*c* in FIG. 6. Differences in between are described in the following. In the light source driving device 100*f* according to the present embodiment, a switching current adjustment circuit 120*f* further includes a third capacitance unit $C_3$ which is connected with an adjusting unit 140*f* in parallel. According to the present embodiment, the adjusting unit 140*f* includes at least one solid state light source 142*f*. For example, the at least one solid state light source 142*f* may be at least one LED or at least one OLED. When the third capacitance unit $C_3$ and the adjusting unit 140*f* are connected in parallel, a current which passes through the adjusting unit 140*f* is maintained to be continuous. Moreover, according to the present embodiment, the third capacitance unit $C_3$ includes at least one non-electrolytic capacitor. For example, the third capacitance unit $C_3$ may include at least one plastic thin film capacitor. However, according to another embodiment, a ceramic capacitor, a laminated ceramic capacitor, or another non-electrolytic capacitor may be used to replace the plastic thin film capacitor.

Figure 11:
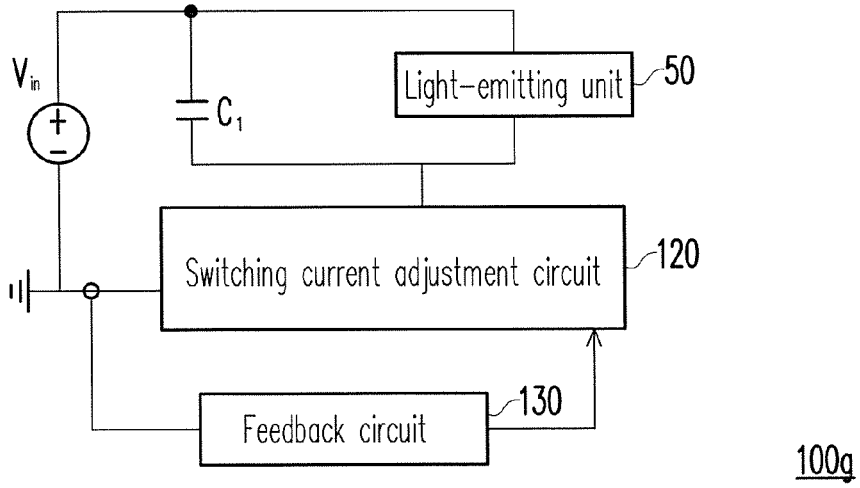
FIG. 11 is a schematic circuit diagram of a light source driving device according to another exemplary embodiment of the disclosure.

FIG. 11 is a schematic circuit diagram of a light source driving device according to another exemplary embodiment of the disclosure. Please refer to FIG. 11. A light source driving device 100*g* is similar to the light source driving device 100 in FIG. 1. Differences in between are described in the following. Also, in the light source driving device 100*g* according to the present embodiment, the feedback circuit 130 is configured to detect a total current which passes through the light-emitting unit 50 and the first capacitance unit $C_1$. The duty cycle of the driving signal of the power switch S is adjusted according to the total current which passes through the light-emitting unit 50 and the first capacitance unit $C_1$, so as to adjust the average current which passes through the light-emitting unit 50. When the total current which passes through the light-emitting unit 50 and the first capacitance unit $C_1$ is too strong, the feedback circuit 130 reduces the duty cycle of the driving signal of the power switch S. Moreover, when the total current which passes through the light-emitting unit 50 and the first capacitance unit $C_1$ is too weak, the feedback circuit 130 increases the duty cycle of the driving signal of the power switch S. The feedback circuit 130 according to the present embodiment may also include a sensing circuit and controlling circuit similar to those in the above embodiment. The sensing circuit is configured to detect the total current which passes through the light-emitting unit 50 and the first capacitance unit $C_1$, so as to generate the feedback signal. The controlling signal is configured to determine the duty cycle of the driving signal of the power switch S according to the feedback signal, wherein the controlling circuit includes an analog controlling integrated circuit or a digital microprocessor.

Figure 12:
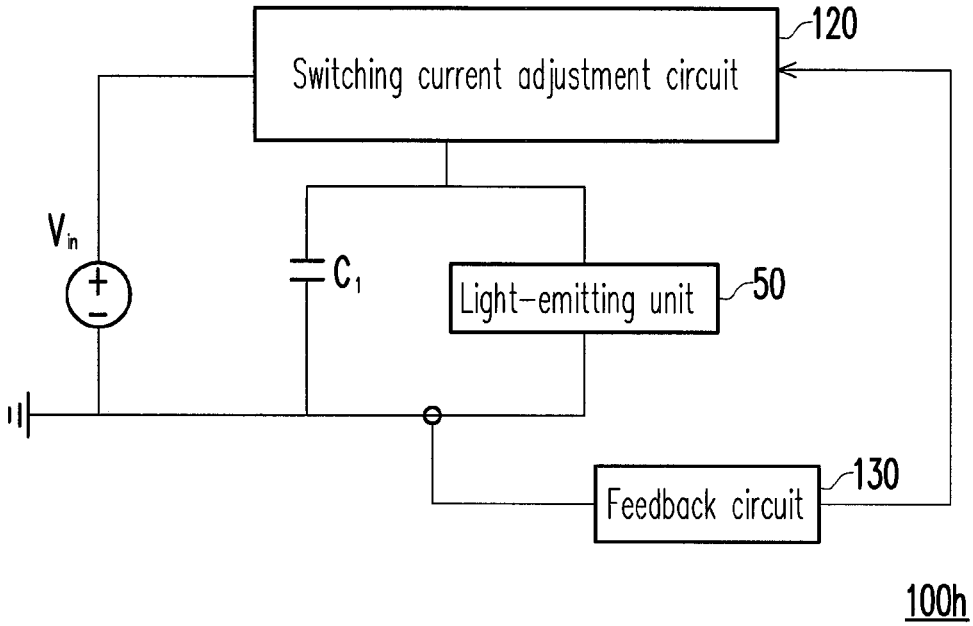
FIG. 12 is a schematic circuit diagram of a light source driving device according to another exemplary embodiment of the disclosure.

FIG. 12 is a schematic circuit diagram of a light source driving device according to another exemplary embodiment of the disclosure. Please refer to FIG. 12. A light source driving device 100*h* is similar to the light source driving device 100 in FIG. 1. Differences in between are described in the following. In the light source driving device 100*h* according to the present embodiment, the switching current adjustment circuit 120 is coupled between the positive end of the direct voltage source $V_{in}$ and the light-emitting unit 50. In other words, after swapping the position of the entirety of the light-emitting unit 50 and the first capacitance unit $C_1$ in the light source driving device 100 in FIG. 1 with the position of the switching current adjustment circuit 120, the light source driving device 100*h* according to the present embodiment is formed. The light source driving device 100*h* according to the present embodiment is also able to achieve the effects of the light source driving device 100 in FIG. 1, and these effects are not repeatedly described.

The following provides an embodiment to describe a detailed structure of the switching current adjustment circuit 120 in the light source driving device 100*h*.

Figure 13:
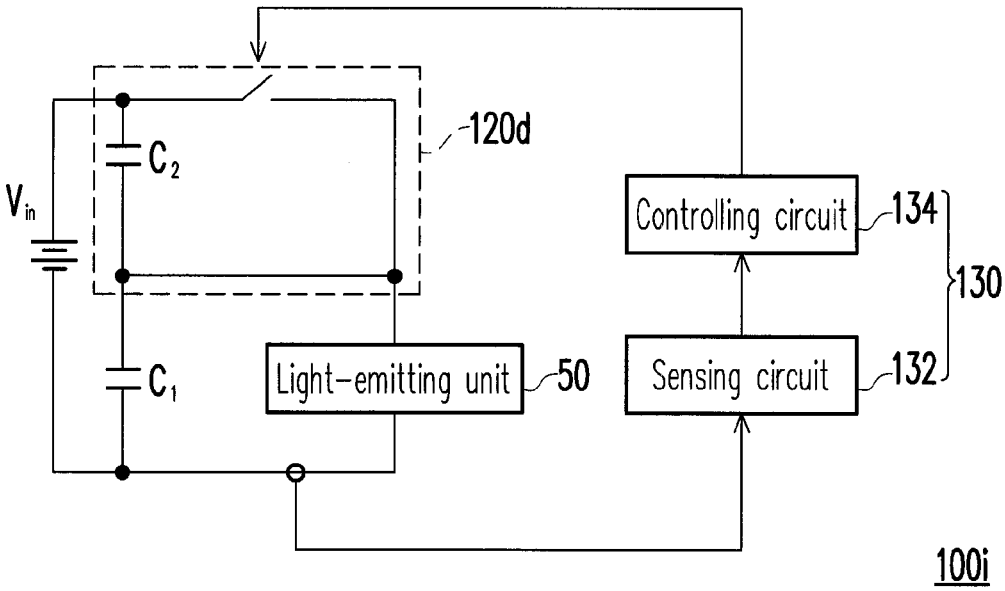
FIG. 13 is a schematic circuit diagram of a light source driving device according to another exemplary embodiment of the disclosure.

FIG. 13 is a schematic circuit diagram of a light source driving device according to another exemplary embodiment of the disclosure. Please refer to FIG. 13. A light source driving device 100*i* is an implementation of the light source driving device 100*h* in FIG. 12. The light source driving device 100*i* according to the present embodiment is similar to the light source driving device 100*d* in FIG. 8, a difference in between is that in the light source driving device 100*i* according to the present embodiment, the switching current adjustment circuit 120*d* is coupled between the positive end of the direct voltage source $V_{in}$ and the light-emitting unit 50. In other words, after swapping the position of the entirety of the light-emitting unit 50 and the first capacitance unit $C_1$ in the light source driving device 100*d* in FIG. 8 with the position of the switching current adjustment circuit 120*d*, the light source driving device 100*i* according to the present embodiment is formed.

Moreover, in the above light source driving devices (such as the light source driving devices 100*a*-100*c* and 100*e*-100*g*), the position of the entirety of the light-emitting unit and the first capacitance unit in the light source driving device may also be similarly swapped with the position of the switching current adjustment circuit, so as to form another type of light source driving device.

Figure 14:
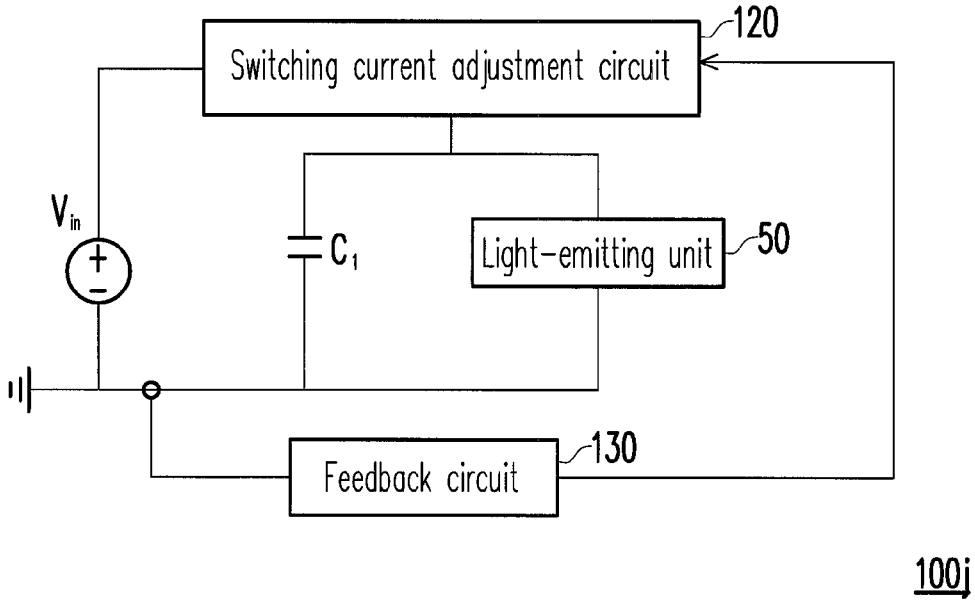
FIG. 14 is a schematic circuit diagram of a light source driving device according to another exemplary embodiment of the disclosure.

FIG. 14 is a schematic circuit diagram of a light source driving device according to another exemplary embodiment of the disclosure. Please refer to FIG. 14. A light source driving device 100*j* according to the present embodiment is similar to the light source driving device 100*h* in FIG. 12. Differences in between are described in the following. The feedback circuit 130 in FIG. 12 is configured to detect the current that passes through the light-emitting unit 50 and to adjust the duty cycle of the driving signal of the switching current adjustment circuit according to the current which passes through the light-emitting unit 50. However, in the light source driving device 100*j* according to the present embodiment, the feedback circuit 130 is configured to detect a total current that passes through the light-emitting unit 50 and the first capacitance unit $C_1$ and to adjust the duty cycle of the driving signal of the switching current adjustment circuit according to the total current which passes through the light-emitting unit 50 and the first capacitance unit $C_1$.

In summary, in the light source driving device according to the embodiments of the disclosure, since the switching current adjustment circuit bears a part of the voltage stress of the direct voltage, a high conversion efficiency is achieved. Therefore, since the voltage stress born by the switching current adjustment circuit 120 is low, the capacitance value of the first capacitance unit is able to be reduced by increasing the switching frequency of the switching current adjustment circuit. Therefore, the first capacitance unit is able to utilize a non-electrolytic capacitor, so as to increase the life span of the first capacitance unit, thereby increasing the life span of the light source driving device.

It will be apparent to those skilled in the art that various modifications and variations can be made to the disclosed embodiments. It is intended that the specification and examples be considered as exemplary only, with a true scope of the disclosure being indicated by the following claims and their equivalents.

What is claimed is:

1. A light source driving device, configured to drive a light-emitting unit, the light source driving device comprises:

a direct voltage source, coupled with the light-emitting unit and configured to provide a direct voltage;

a first capacitance unit, connected with the light-emitting unit in parallel; and a switching current adjustment circuit, connected with the light-emitting unit in series, wherein the switching current adjustment circuit is configured to bear a part of a voltage stress of the direct voltage source and is configured to switch the direct voltage, and the switching current adjustment circuit comprises a power switch connected with the light-emitting unit in series and a second capacitance unit connected with the power switch in parallel.

2. The light source driving device as claimed in claim 1, wherein the light-emitting unit is coupled between a positive end of the direct voltage source and the switching current adjustment circuit.

3. The light source driving device as claimed in claim 1, wherein the switching current adjustment circuit is coupled between a positive end of the direct voltage source and the light-emitting unit.

4. The light source driving device as claimed in claim 1, wherein the switching current adjustment circuit further comprises an adjusting unit which is connected with the power switch in series, and the adjusting unit comprises at least one of a solid state light source, a diode, and a resistor.

5. The light source driving device as claimed in claim 1, wherein the direct voltage source comprises a pure direct voltage source or a pulse direct voltage source.

6. The light source driving device as claimed in claim 1, wherein the light-emitting unit comprises at least one solid state light source.

7. The light source driving device as claimed in claim 6, wherein the solid state light source is a light-emitting diode or an organic light-emitting diode.

8. The light source driving device as claimed in claim 1, wherein the first capacitance unit comprises at least one non-electrolytic capacitor.

9. The light source driving device as claimed in claim 8, wherein the non-electrolytic capacitor comprises a plastic thin film capacitor, a ceramic capacitor, or a laminated ceramic capacitor.

10. The light source driving device as claimed in claim 1, wherein the second capacitance unit comprises at least one non-electrolytic capacitor.

11. The light source driving device as claimed in claim 10, wherein the non-electrolytic capacitor comprises a plastic thin film capacitor, a ceramic capacitor, or a laminated ceramic capacitor.

12. The light source driving device as claimed in claim 1, further comprising a feedback circuit which is configured to detect a current that passes through the light-emitting unit and to adjust a duty cycle of a driving signal of the switching current adjustment circuit according to the current which passes through the light-emitting unit.

13. The light source driving device as claimed in claim 12, wherein the feedback circuit comprises:

a sensing circuit, configured to detect the current which passes through the light-emitting unit to generate a feedback signal; and a controlling circuit, configured to determine the duty cycle of the driving signal of the power switch according to the feedback signal.

14. The light source driving device as claimed in claim 13, wherein the controlling circuit comprises an analog controlling integrated circuit or a digital microprocessor.

15. The light source driving device as claimed in claim 1, further comprising a feedback circuit which is configured to detect a total current which passes through the light-emitting unit and the first capacitance unit and to adjust a duty cycle of a driving signal of the switching current adjustment circuit according to the total current which passes through the light-emitting unit and the first capacitance unit.

16. The light source driving device as claimed in claim 15, wherein the feedback circuit comprises:

a sensing circuit, configured to detect the total current which passes through the light-emitting unit and the first capacitance unit to generate a feedback signal; and a controlling circuit, configured to determine the duty cycle of the driving signal of the power switch according to the feedback signal.

17. The light source driving device as claimed in claim 16, wherein the controlling circuit comprises an analog controlling integrated circuit or a digital microprocessor.

18. A light source driving device configured to drive a light-emitting unit, the light source driving device comprising:

a direct voltage source, coupled with the light-emitting unit and configured to provide a direct voltage;

a first capacitance unit, connected with the light-emitting unit in parallel; and a switching current adjustment circuit, connected with the light-emitting unit in series, wherein the switching current adjustment circuit is configured to bear a part of a voltage stress of the direct voltage source and is configured to switch the direct voltage, wherein the switching current adjustment circuit further comprises a power switch connected with the light-emitting unit in series, an adjust unit connected with the power switch in series, and a second capacitance unit which is connected with an entirety of the power switch and the adjusting unit in parallel.

19. The light source driving device as claimed in claim 18, wherein the switching current adjustment circuit further comprises a third capacitance unit which is connected with the adjusting unit in parallel.

20. The light source driving device as claimed in claim 19, wherein the third capacitance unit comprises at least one non-electrolytic capacitor.

21. The light source driving device as claimed in claim 20, wherein the non-electrolytic capacitor comprises a plastic thin film capacitor, a ceramic capacitor, or a laminated ceramic capacitor.

22. The light source driving device as claimed in claim 19, wherein the adjusting unit comprises at least one light-emitting diode or at least one organic light-emitting diode.

* * * * *